United States Patent [19]

Jonsson et al.

[11] 3,982,367

[45] Sept. 28, 1976

[54] EDGE REINFORCEMENT FOR SANDWICH-TYPE BUILDING PANEL

[76] Inventors: Olov Jonsson, Olivedalsgatan 14 b, S-41310 Göteborg; Edward Milaszewski, Framgangen 210-81, S-41280 Goteborg, both of Sweden

[22] Filed: Nov. 4, 1974

[21] Appl. No.: 520,914

[52] U.S. Cl. ..... 52/309; 52/615; 52/586; 52/624

[51] Int. Cl.[2] ..... E04C 1/00

[58] Field of Search ..... 52/615, 309, 601, 619, 52/628, 624, 586, 585, 612

[56] References Cited

UNITED STATES PATENTS

| | | | |
|---|---|---|---|
| 1,900,805 | 3/1933 | Davis | 52/601 |
| 2,055,804 | 9/1936 | Rafter | 52/601 |
| 2,209,816 | 7/1940 | Grapp | 52/619 |
| 2,324,916 | 7/1943 | Duncan | 52/601 |
| 2,934,934 | 5/1960 | Berliner | 52/309 |
| 3,277,625 | 10/1966 | Van Der Lely | 52/586 |
| 3,512,819 | 5/1970 | Morgan | 52/586 |
| 3,854,263 | 12/1974 | Eckel | 52/615 |

FOREIGN PATENTS OR APPLICATIONS

| | | | |
|---|---|---|---|
| 1,396,538 | 3/1965 | France | 52/615 |
| 76,046 | 7/1961 | France | 52/601 |
| 39,078 | 5/1965 | Germany | 52/615 |
| 713,072 | 9/1966 | Italy | 52/612 |
| 1,000,616 | 8/1965 | United Kingdom | 52/309 |

*Primary Examiner*—Price C. Faw, Jr.
*Assistant Examiner*—Henry Raduazo
*Attorney, Agent, or Firm*—Karl F. Ross; Herbert Dubno

[57] ABSTRACT

An edge reinforcement for a sandwich-type building panel comprises a sheet-metal reinforcing member which extends along the edge of the panel between the two outer plates thereof and is of laterally open box shape. This reinforcement member is formed with a groove adapted to receive a spline that connects together the two like panels. In addition, the reinforcement member is formed on a section extending transverse to the two plates with a plurality of holes so that synthetic resin may be injected through this reinforcement member into the space between the two plates which are separated and held apart by the reinforcement member. The member may comprise a pair of like profiles each lying against a respective outer plate and in turn embracing a single sound-deadening inner plate formed with a plurality of foam-passing holes.

8 Claims, 8 Drawing Figures

Fig. 4a
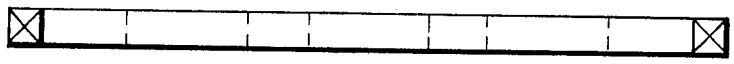
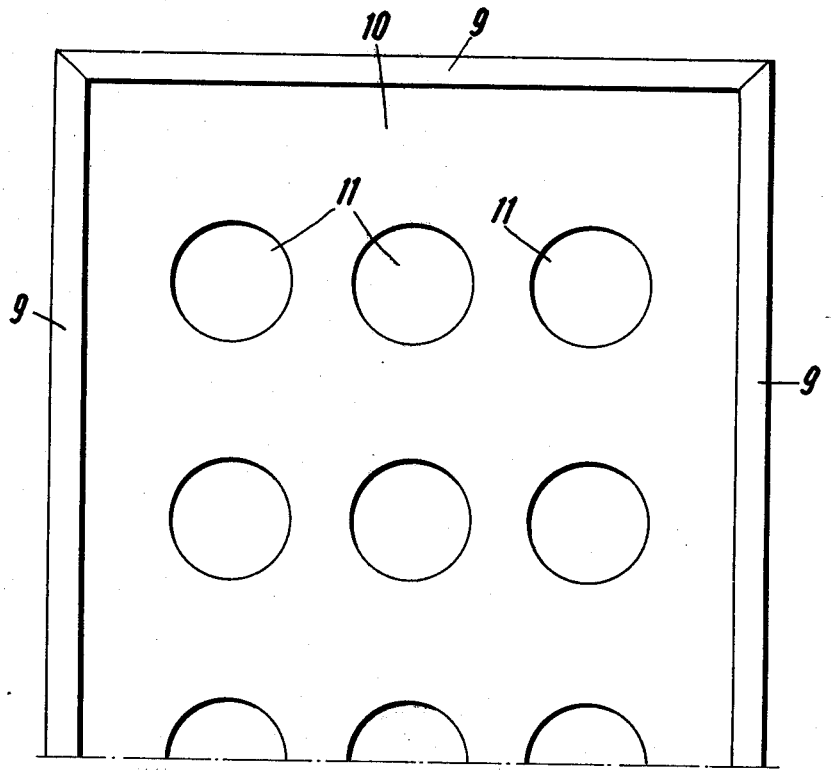
Fig. 4b

EDGE REINFORCEMENT FOR SANDWICH-TYPE BUILDING PANEL

CROSS REFERENCE TO RELATED APPLICATION

This application is related to our copending application Ser. No. 510,739, filed on Sept. 30, 1974 for a SANDWICH-TYPE BUILDING PANEL AND MOUNTING ASSEMBLY THEREFOR.

FIELD OF THE INVENTION

The present invention relates to a construction assembly. More particularly, this invention concerns a sandwich-type construction panel made principally of synthetic-resins material and usable in a floor, ceiling, inside partition wall, or outside wall.

BACKGROUND OF THE INVENTION

Synthetic-resin construction panels are known which basically comprise a pair of rigid outer plates sandwiching a mass of hardened synthetic-resin foam between them. Such panels are provided with edge stiffeners which at the same time must offer considerable resistance to bending while having minimal weight and low heat-conducting capacity. It is necessary that the sandwich panel resist forces at right angles to its plane while at the same time it is necessary that such a panel be limitedly expansible and contractile, principally within its plane, to compensate for temperature changes.

OBJECTS OF THE INVENTION

It is therefor an object of the present invention to provide an improved construction assembly of the above-described general type.

Another object of this invention is the provision of an improved edge reinforcer for sandwich-type building panels.

Yet another object is to provide such an edge stiffener which has minimal weight while offering maximum stiffness.

A further object of such an edge stiffner which insures good interconnection between the various elements of the sandwich panel.

SUMMARY OF THE INVENTION

These objects are attained according to the present invention in a construction assembly basically comprising a sandwich-type building panel whose edge is reinforced with a profiled rigid metal element which extends across the full thickness of the panel and which presents in cross section an open box shape.

According to yet another feature of the invention two such edge stiffeners are provided along the panel edge and have facing sides which define a groove running along the middle of each panel edge. This groove is adapted to receive one or more splines allowing interconnection of the panels.

The arrangement according to the present invention has two principal advantages. It increases the resistance of the panel to bending considerably due to the profile shape of the edge reinforcement. In addition the edge reinforcement forms the groove of the spline systems which allows the rigid interconnection of a plurality of such panels. Thus the possibility that the panels are pushed apart is almost completely eliminated. The modulus of elasticity is thereby increased and a deflection of the central part of the panel is avoided. Edge stiffeners according to the present invention partially unload the outer cover panels from pressure and tension loads and thus lead to a better transmission of forces within the sandwich panel.

Interconnection of the panels by means of the above-described spline/groove system allows limited displacement of the panels within their planes so that expansion or shrinkage due to temperature changes are compensated. A joint between adjacent panels can be formed relatively easily and seals the panels tightly relative to each other so as to prevent the entrance of moisture, wind, noise, and the like.

In accordance with the further feature of this invention a pair of such edge strips are used which flank a central sound-deadening panel which is sandwiched within this foam synthetic mass of the panel between the outer plates. Such a sound-absorbing plate is mounted between the securing flanks of the reinforcing profiles and then the space between the two outer plates is filled with a hardenable synthetic-resin foam. In order to insure that the entire area between the two plates is rapidly and uniformly filled with synthetic-resin foam, that region of the reinforcing strip running parallel to the edge of the panel, i.e., at a right angle to the plane of the panel, is formed with a plurality of throughgoing holes which allow the synthetic-resin mass to flow readily not only to the regions between the plates and within the edge reinforcement, but also around the edge reinforcement and spline. Thus, the entire region between the cover plates of such a panel can readily be filled with synthetic-resin foam.

The sound-deadening plate itself, which according to the present invention is metallic, is formed with a plurality of throughgoing holes that similarly aid in the uniform distribution of the synthetic-resin foam within the sandwich panel.

The holes formed in the reinforcing strip and serving for distribution of the synthetic-resin foam also decreases the heat transmission from one side of the panel to the other, as they reduce the quantity of metal between these sides.

In accordance with another feature of this invention the reinforcing profiles have outer side plates or cheeks which lie directly against the outer cover plates of the sandwich panels. Thus, the spacing of the outer cover panels determines the width of the spline-receiving groove and vice versa, so that a wide variety of different types of panels can be made using the same reinforcing profiles.

BRIEF DESCRIPTION OF THE DRAWING

The above and other objects, features, and advantages of the invention will become more readily apparent from the following description, reference being made to the following drawings in which:

FIGS. 4*a* and 4*b* are side and top views of a sound-deadening plate;

SPECIFIC DESCRIPTION

Figure 1:
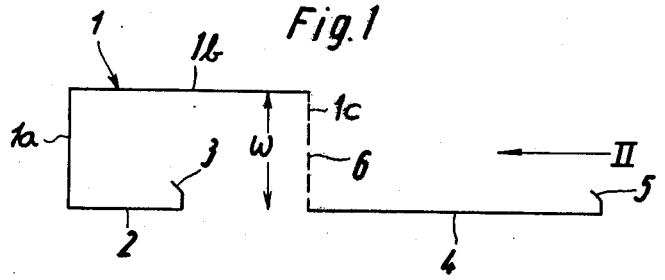
FIG. 1 is an end view of a profiled reinforcing member according to the present invention.
Figure 2:
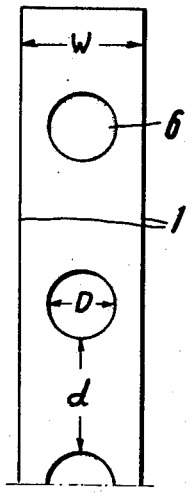
FIG. 2 is a view taken in the direction of arrow II of FIG. 1.
Figure 3:
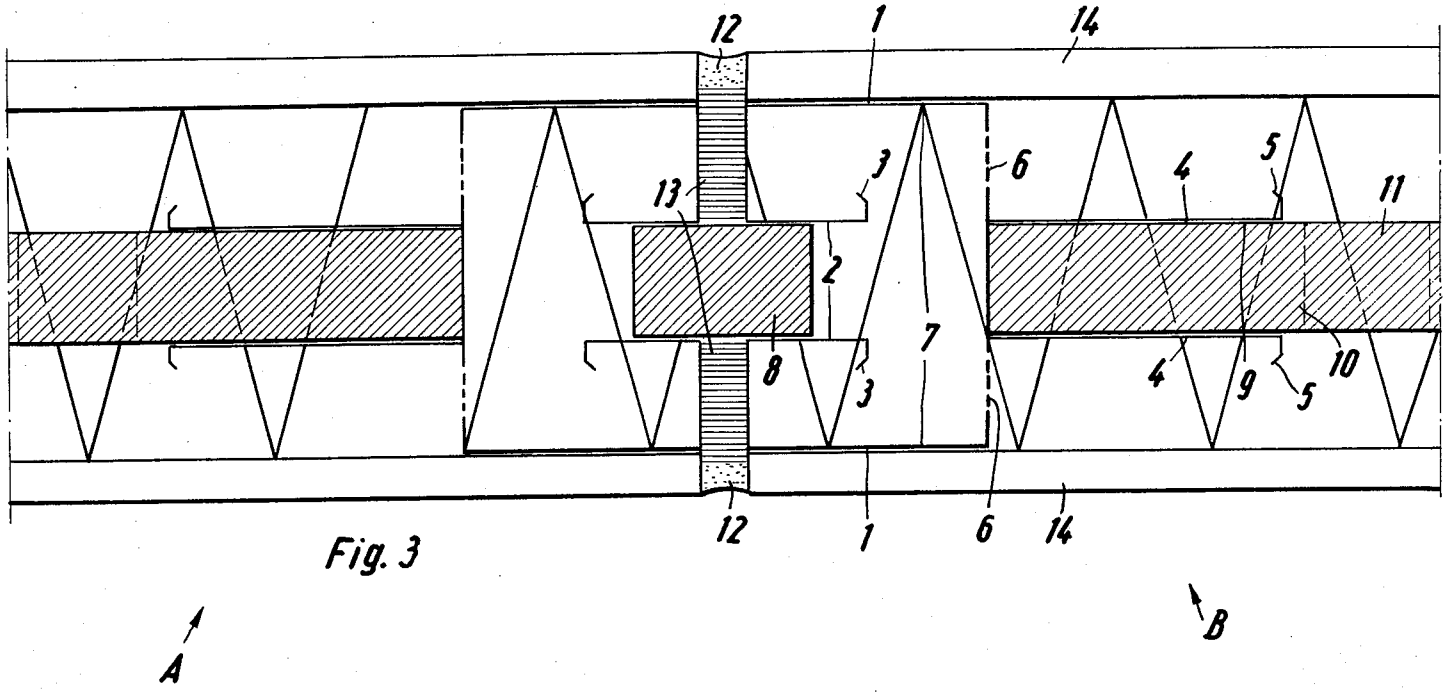
FIG. 3 is a cross section through a joint between a pair of panels provided with the edge reinforcement shown in FIG. 1.

As shown in FIGS. 1–3, an edge reinforcement 1 is formed of a plurality of flat sections of sheet metal, here galvanized steel, profiled so as to have a P-section. The reinforcement strip 1 therefore has a back flap 4 which is planar and terminates at its back end in a hooked or bentover portion 5. A pair of parallel and similar transverse sections 1*a* and 1*c* extend at right angles to section 4 and are joined by another flat section 1*b* parallel to the section 4. Another end section 2 extending from section 1*a* terminates at a bentover portion or hook 3 and is in line with the section 4 so as to form with the sections 1*a*, 1*b*, and 1*c* an open boxlike shape. The section 1*c* is formed with a row of holes 6 having diameters D which are equal to approximately one half the height W of the respective section 1*c*, these holes 6 being spaced apart by a distance *d* equal to approximately 2D.

FIG. 3 shows how a pair of panels A and B are each provided at their edges with a pair of the reinforcing strips 1. These two reinforcing strips therefore form an edge reinforcement 7 for each of the panels A and B. The guide sections 2 define a groove in which a spline 8 joining the two panels A and B is received.

Synthetic-resin foam is injected into the joint between the two panels A and B and flows through the holes 6 into the space between the two rigid outer panels 14. In this manner the two reinforcing strips 1 are securely imbedded in this synthetic-resin mass when it hardens, with the hooks 3 and 5 acting as anchors.

The sections 4 at the rear of each of the strips 1 embrace a sound-deadening plate 5 formed as shown in FIGS. 4*a* and 4*b* with an array of throughgoing holes 11 that allow the synthetic resin to pass through this plate 10 and completely fill the space between the plates 14. Thus, the sound-deadening plate 10, the cover plate 14, and the edge reinforcement 7 constitute before the foaming operation a rigid cassette or boxlike structure into which the liquid synthetic-resin material can be injected so as to completely fill the space between these plates 14 and harden. The gap between the edges of the two panels A and B is filled with a mass 13 and finally caulked as shown at 12. This mass 13 and the caulk 12 are elastic so as to allow limited displacement of the panels A and B relative to each other in their own planes. Compensation for temperature changes is therefore possible. In addition the entry of moisture, air, noise, or fire through the joints between the two panels is completely ruled out.

There is provided around the edge of the sound-deadening plate 10 an attachment frame 9 by means of which the plate 10 is secured between a pair of like reinforcement profiles 1.

Figure 5:
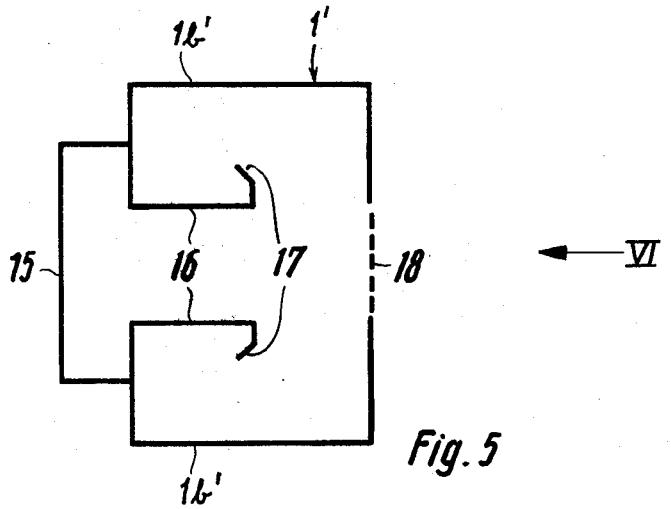
FIG. 5 is an end view of another edge reinforcement in accordance with this invention.
Figure 6:
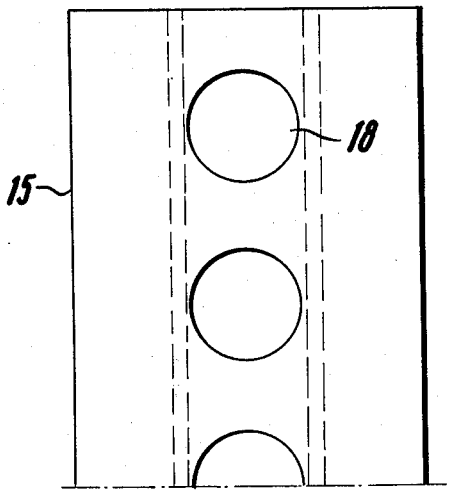
FIG. 6 is a view taken in the direction of arrow VI of FIG. 5.

FIGS. 5 and 6 show a one-piece edge reinforcement 1′ having a generally laterally open box shape and formed with a pair of outer parallel sides 1*b*′. The front section 15 lie in a common plane to either side of a groove or space defined between a pair of inner sections 16 bent over at 17 into anchor hooks. In addition the back wall of the unit 1′ is formed with a row of like holes 18 which serve both to allow the introduction of synthetic-resin foam into a panel and interrupt heat flow from one side of the edge reinforcer 1′ to the other.

Figure 7:
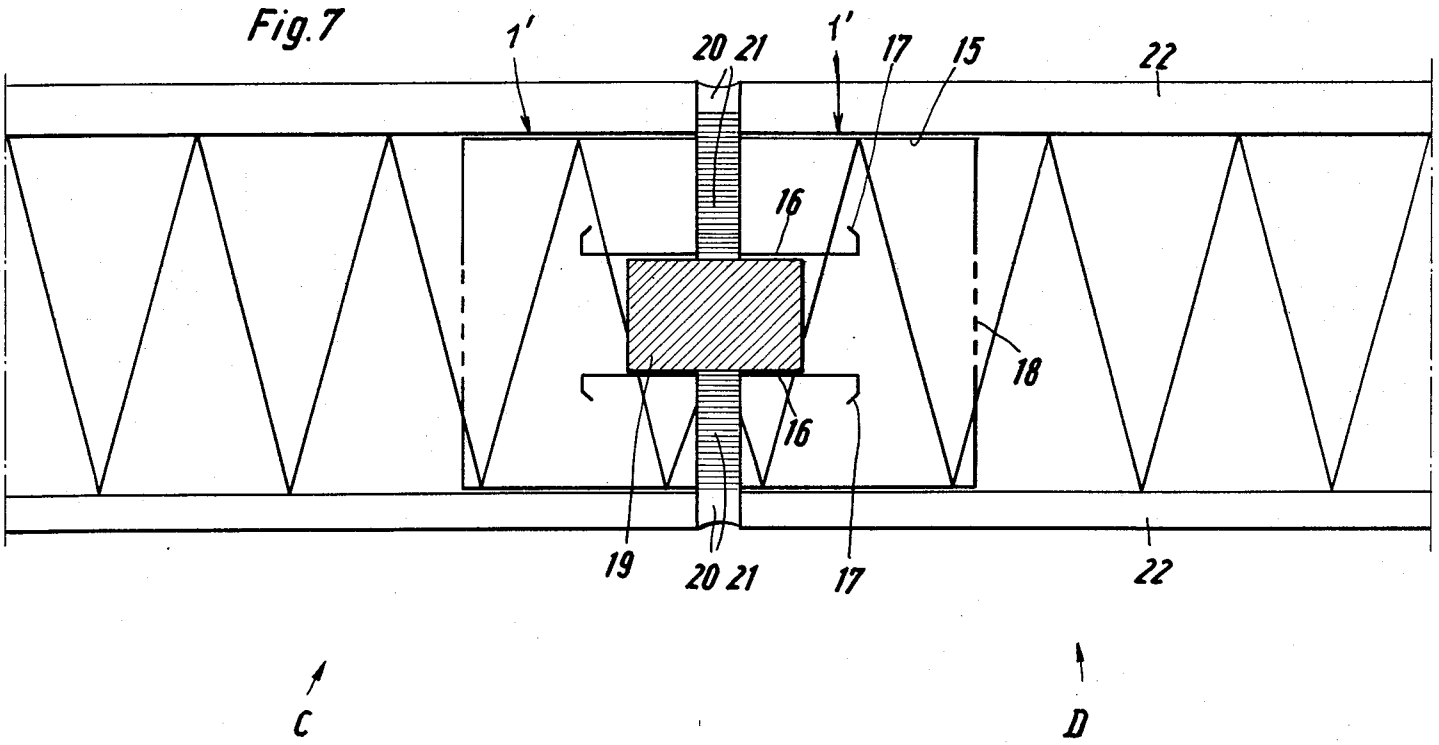
FIG. 7 is a cross section through a joint between two panels provided with the edge reinforcement of FIGS. 5 and 6.

FIG. 7 illustrates how the two panels G and D are joined together, each panel being provided at its edge with a single such unit 1′, lying between the outer rigid plates 22. A spline 19 is received between the inner sections or cheeks 16 and caulk 20 and filling material 21 are received between the ends of the plates. The plates 22 and the edge stiffener 15 form with the unit 1′ a rigid open cassette before filling of the space between the panels 22 with the synthetic-resin foam.

We claim:

1. A construction panel comprising:
   - a pair of rigid plates having transversely spaced apart edges;
   - a hardened mass of synthetic-resin foam between said plates bonding the same together;
   - an elongated rigid edge-reinforcing member of laterally open box-shape received between said plates and said edges and spanning the thickness of the space between them, said member having cheeks lying along opposite internal faces of said plates and defining a laterally open groove adapted to receive a spline, said member being further formed with a section extending transverse to the plates and provided with a plurality of holes for the passage of the synthetic-resin foam in liquid condition through said member, said member having extensions formed with hooks anchoring the member in said mass; and
   - a spline for connecting the panel to a like panel, said spline being received in said groove, said member comprising a pair of like parallel profiles each abutting a respective one of said plates and having an inner section parallel to the respective plate and defining a side of said groove.

2. The panel defined in claim 1, further comprising a sound-deadening plate received between said profiles.

3. The panel described in claim 2 wherein said profiles have backwardly extending sections parallel to the respective plates and embracing said sound-deadening plate.

4. The panel described in claim 2 wherein said sound-deadening plate is formed with a plurality of throughgoing holes.

5. The panel described in claim 1 wherein said member is made of sheet metal and is of uniform cross-sectional shape.

6. The panel described in claim 5 wherein said member is formed of a sheet-metal plate having a pair of longitudinal edges each bent up to form an anchoring hook.

7. The panel defined in claim 5 wherein said plate is bent along a plurality of parallel bends so as to be formed of a plurality of flat sections.

8. A construction panel comprising:
   - a pair of spaced apart coextensive rigid plates having transversely spaced edges;
   - a hardened mass of synthetic-resin foam between said plates bonds the same together;
   - a sound-deadening plate embedded in said mass between said rigid plates and spaced therefrom; and
   - an edge reinforcement comprising a pair of profiles deposited at said edges, each of said profiles being formed as an angularly bent sheet having an open-box configuration along a respective one of said edges, said profiles having respective cheeks lying along respective internal faces of said rigid plates and defining a laterally open groove adapted to receive a spline for connecting the panel to a like panel, said profiles each being formed with sections transverse to the respective rigid plates provided with holes for the passage of a synthetic-resin material, and with a further section extending away from said edges into the interior of the panel, said further sections flanking said sound-deadening plate and being provided with hooks embedded in said mass.

* * * * *